US006443249B2

(12) United States Patent
Beuershausen et al.

(10) Patent No.: US 6,443,249 B2
(45) **Date of Patent: *Sep. 3, 2002**

(54) ROTARY DRILL BITS FOR DIRECTIONAL DRILLING EXHIBITING VARIABLE WEIGHT-ON-BIT DEPENDENT CUTTING CHARACTERISTICS

(75) Inventors: Christopher C. Beuershausen, Lafayette, LA (US); Mark W. Dykstra, Kingwood, TX (US); Roger Fincher, Conroe, TX (US); Roland Illerhaus, The Woodlands, TX (US); Steve R. Matson, Spring, TX (US); James A. Norris, Sandy, UT (US); Michael P. Ohanian, Slidell, LA (US); Rudolf C. O. Pessier, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/854,765

(22) Filed: May 14, 2001

Related U.S. Application Data

(63) Continuation of application No. 08/925,525, filed on Sep. 8, 1997, now Pat. No. 6,230,828.

(51) Int. Cl.[7] ..... E21B 10/46
(52) U.S. Cl. ..... 175/431
(58) Field of Search ..... 175/426, 428, 175/430, 431

(56) References Cited

U.S. PATENT DOCUMENTS

| | | | |
|---|---|---|---|
| 4,342,368 | A | 8/1982 | Denman |
| RE32,036 | E | 11/1985 | Dennis |
| 4,558,753 | A | 12/1985 | Barr |
| 4,607,711 | A | 8/1986 | Zijsling |
| 4,660,659 | A | 4/1987 | Short, Jr. et al. |
| 4,673,044 | A | 6/1987 | Bigelow et al. |
| 4,792,001 | A | 12/1988 | Zijsling |
| 4,808,044 | A | 2/1989 | Tsujimura et al. |
| 4,926,950 | A | 5/1990 | Zijsling |
| 4,932,484 | A | 6/1990 | Warren et al. |
| 5,016,718 | A | 5/1991 | Tandberg |
| 5,437,343 | A | 8/1995 | Cooley et al. |
| 5,443,565 | A | 8/1995 | Strange, Jr. |
| 5,467,836 | A | 11/1995 | Grimes et al. |
| 5,549,171 | A | 8/1996 | Mensa-Wilmot et al. |
| 5,605,198 | A | 2/1997 | Tibbitts et al. |
| 5,655,612 | A | 8/1997 | Grimes et al. |
| 5,706,906 | A | 1/1998 | Jurewicz et al. |
| 5,960,896 | A | 10/1999 | Barr et al. |

FOREIGN PATENT DOCUMENTS

| | | | |
|---|---|---|---|
| GB | 2 323 398 | A | 9/1998 |

OTHER PUBLICATIONS

Search Report under Section 17 dated Jan. 7, 1999.

*Primary Examiner*—William Neuder
*Assistant Examiner*—Sunil Singh
(74) *Attorney, Agent, or Firm*—TraskBritt

(57) ABSTRACT

A PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

14 Claims, 8 Drawing Sheets

ROTARY DRILL BITS FOR DIRECTIONAL DRILLING EXHIBITING VARIABLE WEIGHT-ON-BIT DEPENDENT CUTTING CHARACTERISTICS

CROSS-REFERENCE TO RELATED APPLICATION

This application is a continuation of application Ser. No. 08/925,525, filed Sep. 8, 1997, now U.S. Pat. No. 6,230,828 issued May 15, 2001.

BACKGROUND OF THE INVENTION

1. Field of the Invention

The present invention relates generally to rotary bits for drilling subterranean formations. More specifically, the invention relates to fixed cutter or so-called "drag" bits suitable for directional drilling, wherein cutting edge chamfer geometries are varied at different locations or zones on the face of the bit, the variations being tailored to enhance response of the bit to sudden variations in load and improve stability of the bit as well as rate of penetration (ROP).

2. State of the Art

In state-of-the-art directional drilling of subterranean formations, also sometimes termed steerable or navigational drilling, a single bit disposed on a drill string, usually connected to the drive shaft of a downhole motor of the positive-displacement (Moineau) type, is employed to drill both linear and non-linear borehole segments without tripping of the string from the borehole. Use of a deflection device such as a bent housing, bent sub, eccentric stabilizer, or combinations of the foregoing in a bottomhole assembly (BHA), including a motor, permits a fixed rotational orientation of the bit axis at an angle to the drill string axis for non-linear drilling when the bit is rotated solely by the motor drive shaft. When the drill string is rotated in combination with rotation of the motor shaft, the superimposed rotational motions cause the bit to drill substantially linearly. Other directional methodologies employing non-rotating BHAs using lateral thrust pads or other members immediately above the bit also permit directional drilling using drill string rotation alone.

In either case, for directional drilling of non-linear borehole segments, the face aggressiveness (aggressiveness of the cutters disposed on the bit face) is a critical feature, since it is largely determinative of how a given bit responds to sudden variations in bit load. Unlike roller cone bits, rotary drag bits employing fixed superabrasive cutters (usually comprising polycrystalline diamond compacts, or "PDCs") are very sensitive to load, which sensitivity is reflected in a much steeper rate of penetration (ROP) versus weight on bit (WOB) and torque on bit (TOB) versus WOB curves, as illustrated in FIGS. 1 and 2 of the drawings. Such high WOB sensitivity causes problems in directional drilling, wherein the borehole geometry is irregular and resulting "sticktion" of the BHA when drilling a non-linear path renders a smooth, gradual transfer of weight to the bit extremely difficult. These conditions frequently cause motor stalling and loss or swing of tool face orientation. When tool face is lost, borehole quality declines. In order to establish a new tool face reference point before drilling is recommence, the driller must stop drilling ahead and pull the bit off the bottom of the borehole, with a resulting loss of time and thus ROP. Conventional methods to reduce rotary drag bit face aggressiveness include greater cutter densities, higher (negative) cutter backrakes and the addition of wear knots to the bit face.

Of the bits referenced in FIGS. 1 and 2 of the drawings, RC comprises a conventional roller cone bit for reference purposes, while FC1 is a conventional polycrystalline diamond compact (PDC) cutter-equipped rotary drag bit having cutters backraked at 20°, while FC2 is the directional version of the same bit with 30° backraked cutters. As can be seen from FIG. 2, the TOB at a given WOB for FC2, which corresponds to its face aggressiveness, can be as much as 30% less than for FC1. Therefore, FC2 is less affected by the sudden load variations inherent in directional drilling. However, referencing FIG. 1, it can also be seen that the less aggressive FC2 bit exhibits a markedly reduced ROP for a given WOB, in comparison to FIG. 2.

Thus, it may be desirable for a bit to demonstrate the less aggressive characteristics of a conventional directional bit such as FC2 for non-linear drilling without sacrificing ROP to the same degree when WOB is increased to drill a linear borehole segment.

For some time, it has been known that forming a noticeable, annular chamfer on the cutting edge of the diamond table of a PDC cutter has enhanced durability of the diamond table, reducing its tendency to spall and fracture during the initial stages of a drilling operation before a wear flat has formed on the side of the diamond table and supporting substrate contacting the formation being drilled.

U.S. Pat. No. Re 32,036 to Dennis discloses such a chamfered cutting edge, disc-shaped PDC cutter comprising a polycrystalline diamond table formed under high pressure and high temperature conditions onto a supporting substrate of tungsten carbide. For conventional PDC cutters, a typical chamfer size and angle would be 0.010 inch (measured radially and looking at and perpendicular to the cutting face) oriented at a 45° angle with respect to the longitudinal cutter axis, thus providing a larger radial width as measured on the chamfer surface itself. Multi-chamfered PDC cutters are also known in the art, as taught by Cooley et al. U.S. Pat. No. 5,437,343, assigned to the assignee of the present invention. Rounded, rather than chamfered, cutting edges are also known, as disclosed in U.S. Pat. No. 5,016,718 to Tandberg.

For some period of time, the diamond tables of PDC cutters were limited in depth or thickness to about 0.030 inch or less, due to the difficulty in fabricating thicker tables of adequate quality. However, recent process improvements have provided much thicker diamond tables, in excess of 0.070 inch, up to and including 0.150 inch. U.S. patent application Ser. No. 08/602,076, now U.S. Pat. No. 5,706,906, assigned to the assignee of the present invention, discloses and claims several configurations of a PDC cutter employing a relatively thick diamond table. Such cutters include a cutting face bearing a large chamfer or "rake land" thereon adjacent the cutting edge, which rake land may exceed 0.050 inch in width, measured radially and across the surface of the rake land itself Other cutters employing a relatively large chamfer without such a great depth of diamond table are also known.

Recent laboratory testing, as well as field tests, have conclusively demonstrated that one significant parameter affecting PDC cutter durability is the cutting edge geometry. Specifically, larger leading chamfers (the first chamfer on a cutter to encounter the formation when the bit is rotated in the normal direction) provide more durable cutters. The robust character of the above-referenced "rake land" cutters corroborates these findings. However, it was also noticed that cutters exhibiting large chamfers would also slow the overall performance of a bit so equipped, in terms of ROP. This characteristic of large chamfer cutters was perceived as a detriment.

BRIEF SUMMARY OF THE INVENTION

The inventors herein have recognized that varying chamfer size and chamfer rake angle of various PDC cutters as a function of, or in relationship to, cutter redundancy at varying radial locations on the bit face may be employed to provide a bit exhibiting relatively low aggressiveness and good stability while affording adequate side cutting capability for non-linear drilling, as well as providing greater ROP when drilling linear borehole segments than conventional directional or steerable bits with highly backraked cutters.

The present invention comprises a rotary drag bit equipped with PDC cutters, wherein cutters in the low cutter redundancy center region of the bit exhibit a relatively large chamfer and are oriented at a relatively large backrake, while chamfer size as well as chamfer rake angle decreases in cutters located more toward the outer region, or gage, of the bit, wherein higher cutter redundancy is employed.

Such a bit design noticeably changes the ROP and TOB versus WOB characteristics for the bit from the linear, single slope curves shown in FIGS. 1 and 2 for FC1 and FC2 to exponential, dual-slope curves as shown with respect to a bit FC3 according to the invention.

It is the dual-slope characteristics which are desirable for directional drilling, demonstrating that a bit such as FC3 is slow and drills smoothly with less applied torque at a relatively low WOB such as is applied during oriented drilling of a non-linear well bore segment, while regaining its full ROP potential at relatively higher WOB levels such as are applied during linear drilling.

It has been found that the chamfer size predominantly determines at which ROP or WOB level the break in between the two slopes occurs, while the chamfer backrake angle predominantly determines curve slopes at low WOB, and cutter backrake angles dictate the slopes at high WOB. The chamfer backrake angle with respect to the formation being cut may be modified by actually changing the chamfer angle on the cutter, changing the backrake angle of the cutter itself, or a combination of the two. Thus, different slopes at low WOB may be achieved for bits employing cutters with similar chamfer angles, but disposed at different cutter backrake angles, or bits employing cutters with different chamfer angles but disposed at similar cutter backrake angles. Generally, placing relatively less aggressive cutters in the center of the bit face and relatively more aggressive cutters toward the gage makes the bit more stable. In a broad concept of the invention, chamfer size and angle of cutters placed at a variety of radial locations over the face of a bit may be varied as a function of, or in relation to, cutter redundancy at the various locations.

DETAILED DESCRIPTION OF THE INVENTION

As used in the practice of the present invention, and with reference to the size of the chamfers employed in various regions of the exterior of the bit, it should be recognized that the terms "large" and "small" chamfers are relative, not absolute, and that different formations may dictate what constitutes a relatively large or small chamfer on a given bit. The following discussion of "small" and "large" chamfers is, therefore, merely exemplary and not limiting, in order to provide an enabling disclosure and the best mode of practicing the invention as currently understood by the inventors.

Figure 3A:
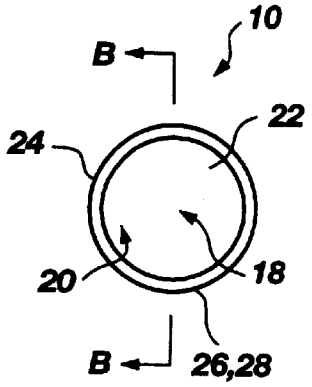
FIG. 3A comprises a frontal view of a small chamfer PDC cutter usable with the present invention and FIG. 3B comprises a side sectional view of the small chamfer PDC cutter of FIG. 3A, taken along section lines B—B.
Figure 3B:
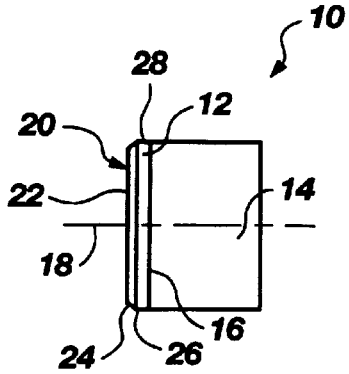

FIGS. 3A and 3B depict an exemplary "small chamfer" cutter 10 comprised of a superabrasive, PDC table 12, supported by a tungsten carbide (WC) substrate 14, as known in the art. The interface 16 between the PDC diamond table 12 and the substrate 14 may be planar or non-planar, according to many varying designs for same as known in the art. Cutter 10 is substantially cylindrical, and symmetrical about longitudinal axis 18, although such symmetry is not required and non-symmetrical cutters are known in the art. Cutting face 20 of cutter 10, to be oriented on a bit facing generally in the direction of bit rotation, extends substantially transversely to such direction, and to axis 18. The surface 22 of the central portion of cutting face 20 is planar as shown, although concave, convex, ridged or other substantially, but not exactly, planar surfaces may be employed. A chamfer 24 extends from the periphery of surface 22 to cutting edge 26 at the sidewall 28 of PDC table 12. Chamfer 24 and cutting edge 26 may extend about the entire periphery of PDC table 12, or only along a periphery portion to be located adjacent the formation to be cut. Chamfer 24 may comprise the aforementioned 0.010 inch by 45° angle conventional chamfer, or the chamfer may lie at some other angle, as referenced with respect to the chamfer 124 of cutter 110 described below. While 0.010 inch chamfer size is referenced as an example (within conventional tolerances), chamfer sizes within a range of 0.005 to about 0.020 inch are contemplated as generally providing a "small" chamfer for the practice of the invention. It should also be noted that cutters exhibiting substantially no visible chamfer may be employed for certain applications in selected outer regions of the bit.

Figure 4:
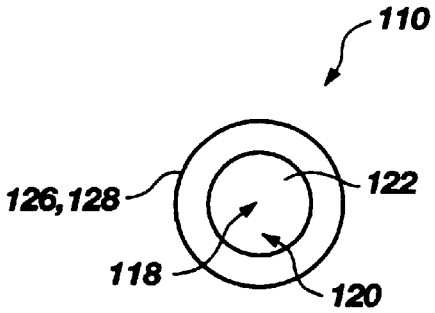
FIG. 4 comprises a frontal view of a large chamfer PDC cutter usable with the present invention.
Figure 5:
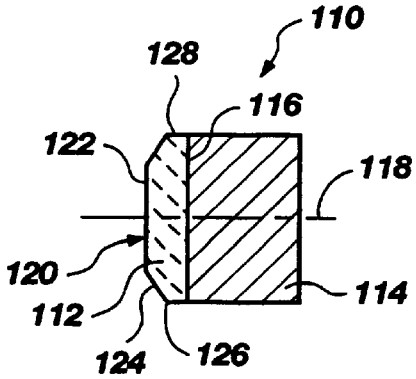
FIG. 5 comprises a side sectional view of a first internal configuration for the large chamfer PDC cutter of FIG. 4.
Figure 6:
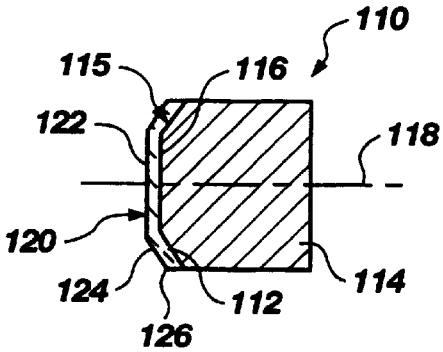
FIG. 6 comprises a side sectional view of a second internal configuration for the large chamfer PDC cutter of FIG. 4.
Figure 7:
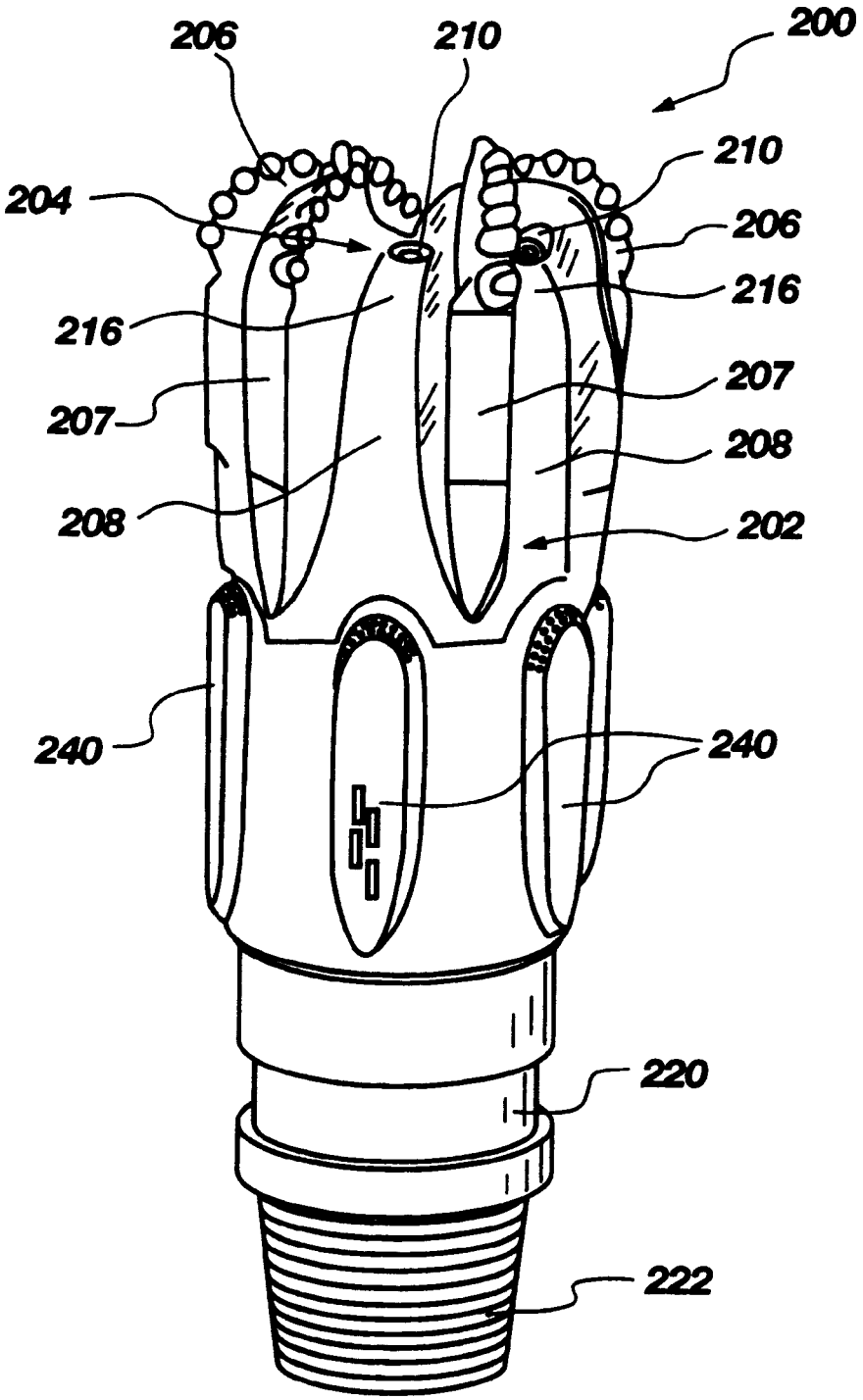
FIG. 7 comprises a side perspective view of a PDC-equipped rotary drag bit according to the present invention.
Figure 8:
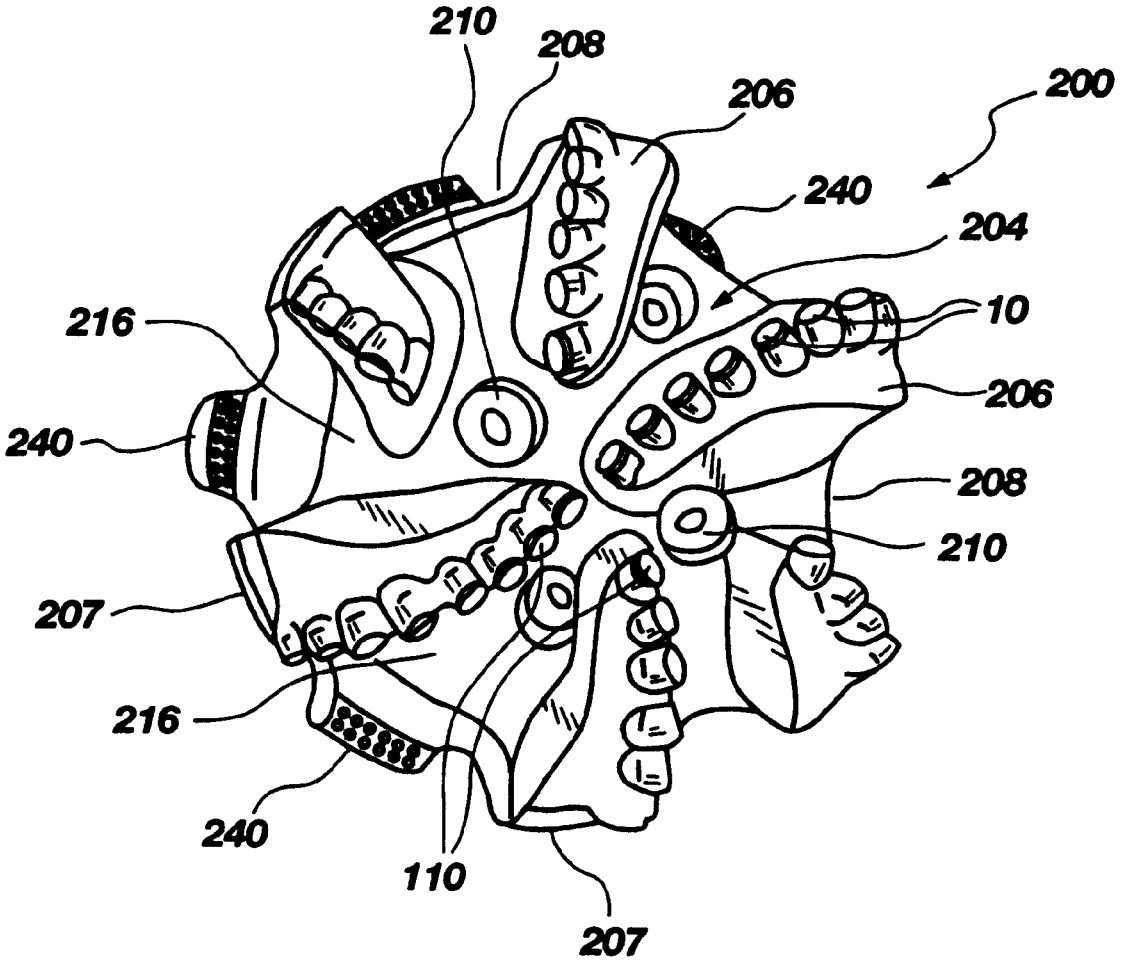
FIG. 8 comprises a face view of the bit of FIG. 7.

FIGS. 4 through 6 depict an exemplary "large chamfer" cutter 110 comprised of a superabrasive, PDC table 112 supported by a WC substrate 114. The interface 116 between the PDC diamond table 112 and the substrate 114 may be planar or non-planar, according to many varying designs for same as known in the art (see especially FIGS. 5 and 6). Cutter 110 is substantially cylindrical, and symmetrical about longitudinal axis 118, although such symmetry is not required and non-symmetrical cutters are known in the art. Cutting face 120 of cutter 110, to be oriented on a bit facing generally in the direction of bit rotation, extends substantially transversely to such direction, and to axis 118. The surface 122 of the central portion of cutting face 120 is planar, as shown, although concave, convex, ridged or other substantially, but not exactly, planar surfaces may be employed. A chamfer 124 extends from the periphery of surface 122 to cutting edge 126 at the sidewall 128 of PDC table 112. Chamfer 124 and cutting edge 126 may extend about the entire periphery of PDC table 112, or only along a periphery portion to be located adjacent the formation to be cut. Chamfer 124 may comprise a surface oriented at 45° to axis 118, of a width, measured radially and looking at and perpendicular to the cutting face 120, ranging upward in magnitude from about 0.030 inch, and generally lying within a range of about 0.030 to 0.060 inch in width. Chamfer angles of about 10° to about 80° to axis 118 are believed to have utility, with angles in the range of about 30° to about 60° being preferred for most applications. The effective angle of a chamfer relative to the formation face being cut may also be altered by changing the backrake of a cutter.

FIG. 5 illustrates one internal configuration for cutter 110, wherein PDC table 112 is extremely thick, on the order of 0.070 inch or greater, in accordance with the teachings of the aforementioned '076 application.

FIG. 6 illustrates a second internal configuration for cutter 110, wherein the front face 115 of substrate 114 is frusto-conical in configuration, and PDC table 112, of substantially constant depth, substantially conforms to the shape of front face 115 to provide a large chamfer of a desired width without requiring the large PDC diamond mass of the '076 application.

FIGS. 7 through 10 depict a rotary drag bit 200 according to the invention. Bit 200 includes a body 202 having a face 204 and including a plurality (in this instance, six) of generally radially oriented blades 206 extending above the bit face 204 to a gage 207. Junk slots 208 lie between adjacent blades 206. A plurality of nozzles 210 provides drilling fluid from plenum 212 (FIG. 10) within the bit body 202 and received through passages 214 (FIG. 10) to the bit face 204. Formation cuttings generated during a drilling operation are transported by the drilling fluid across bit face 204 through fluid courses 216 communicating with respective junk slots 208. Secondary gage pads 240 are rotationally and substantially longitudinally offset from blades 206, and provide additional stability for bit 200 when drilling both linear and non-linear borehole segments. Such added stability reduces the incidence of ledging of the borehole sidewall, and spiraling of the borehole path. Shank 220 includes a threaded pin connection 222 as known in the art, although other connection types may be employed.

Figure 10:
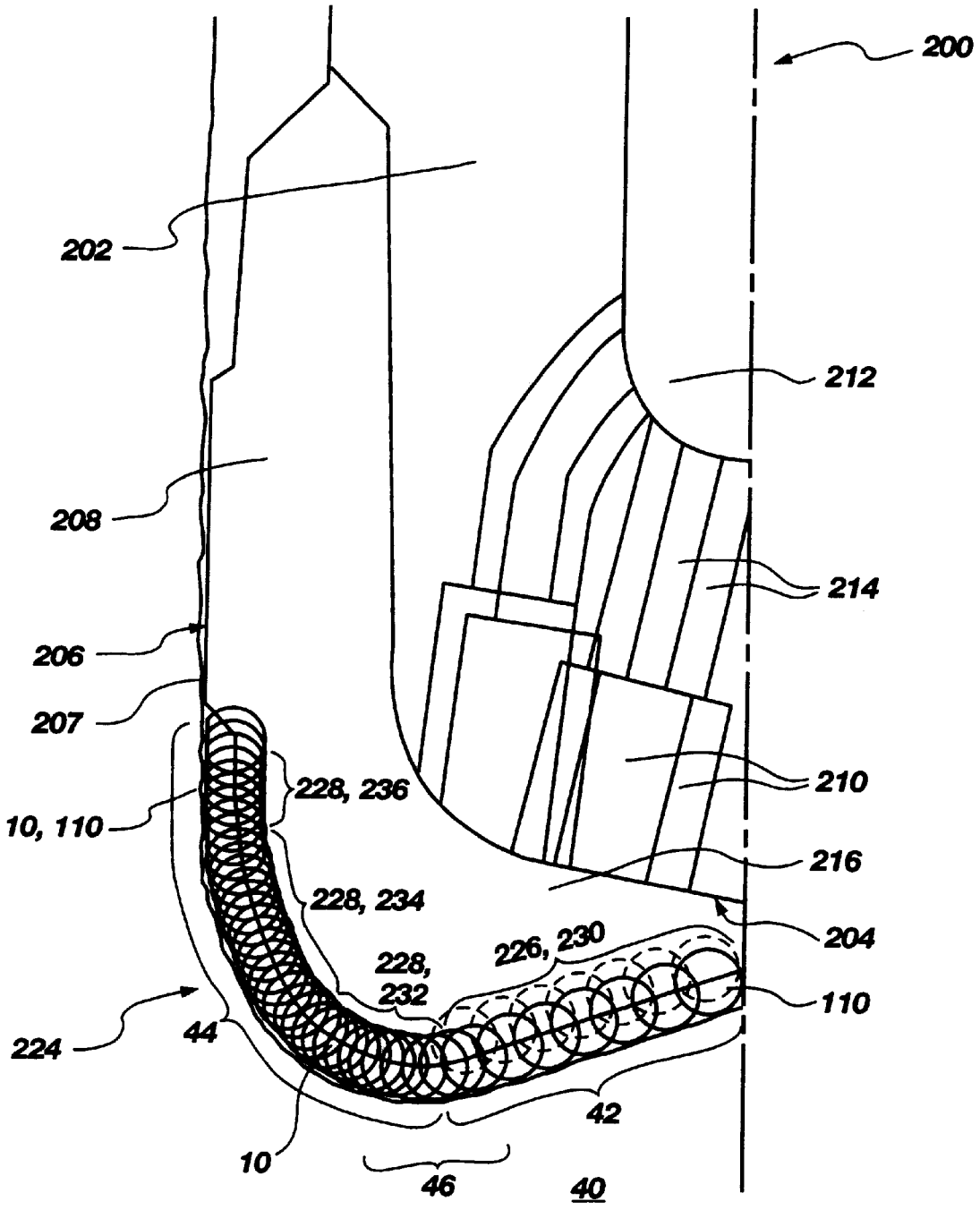

The profile 224 of the bit face 204, as defined by blades 206, is illustrated in FIG. 10, wherein bit 200 is shown adjacent a subterranean rock formation 40 at the bottom of the well bore. First region 226 and second region 228 on profile 224 face adjacent rock zones 42 and 44 of formation 40 and respectively carry large chamfer cutters 110 and small chamfer cutters 10. First region 226 may be said to comprise the cone 230 of the bit profile 224, as illustrated, whereas second region 228 may be said to comprise the nose 232, and flank 234 and extend to shoulder 236 of profile 224, terminating at gage 207.

Figure 9:
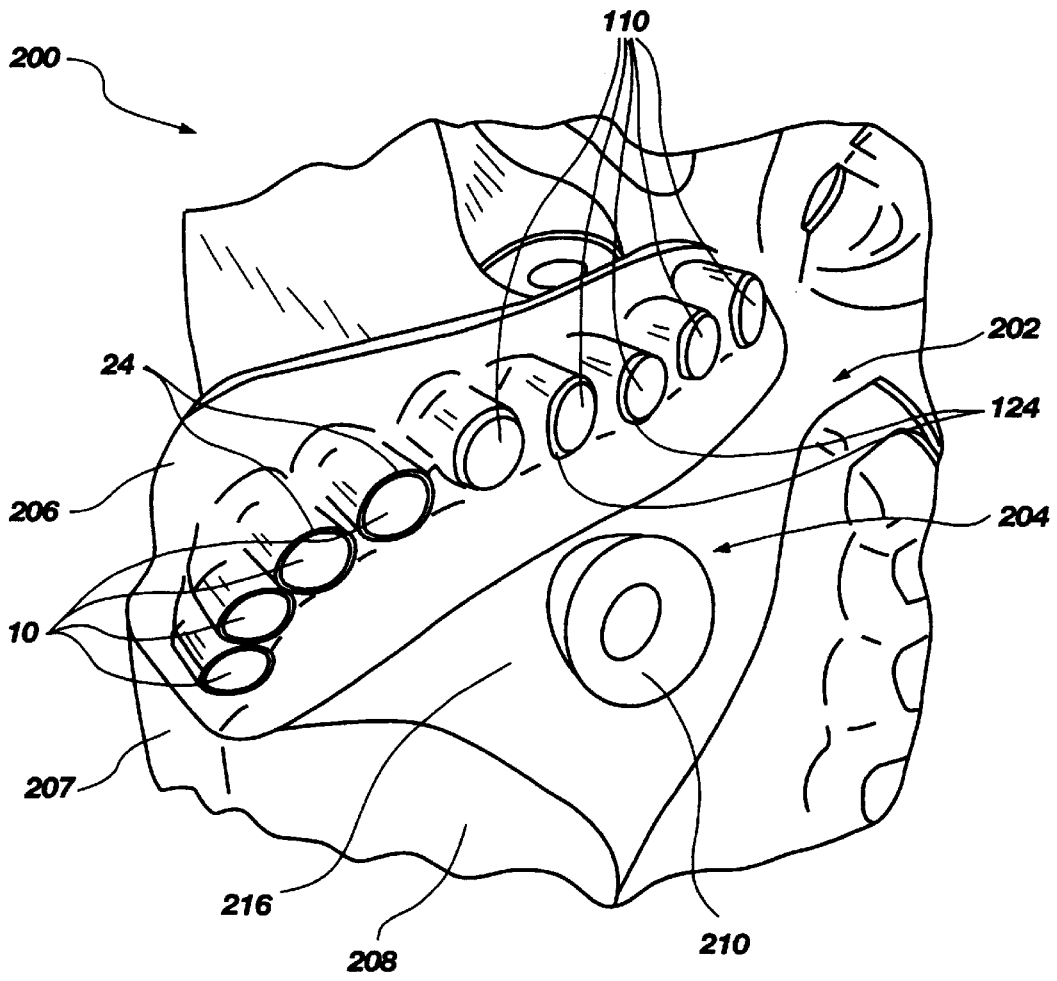
FIG. 9 comprises an enlarged, oblique face view of a single blade of the bit of FIG. 7, illustrating the varying cutter chamfer sizes and angles and cutter rake angles employed, FIG. 10 comprises a quarter-sectional side schematic of a bit having a profile such as that of FIG. 7, with the cutter locations rotated to a single radius extending from the bit centerline to the gage to show the radial bit face locations of the various cutter chamfer sizes and angles, and cutter backrake angles, employed in the bit.

In a currently preferred embodiment of the invention and with particular reference to FIGS. 9 and 10, large chamfer cutters 110 may comprise cutters having PDC tables in excess of 0.070 inch depth, and preferably about 0.080 to 0.090 inch depth, with chamfers 124 of about a 0.030 to 0.060 inch width, looking at and perpendicular to the cutting face 120, and oriented at a 45° angle to the cutter axis 118. The cutters themselves, as disposed in first region 226, are backraked at 20° to the bit profile (see cutters 110 shown partially in broken lines in FIG. 10 to denote 20° backrake) at each respective cutter location, thus providing chamfers 124 with a 65° backrake. Cutters 10, on the other hand, disposed in second region 228, may comprise conventionally-chamfered cutters having about a 0.030 inch PDC table thickness, and about a 0.010 to 0.020 inch chamfer width looking at and perpendicular to cutting face 20, with chamfers 24 oriented at a 45° angle to the cutter axis 18. Cutters 10 are themselves backraked at 15° on nose 232, providing a 60° chamfer backrake, while cutter backrake is further reduced to 10° at the flank 234, shoulder 236 and on the gage 207 of bit 200, resulting in a 55° chamfer backrake. The PDC cutters 10 immediately above gage 207 include performed flats thereon oriented parallel to the longitudinal axis of the bit 200, as known in the art. In steerable applications requiring greater durability at the shoulder 236, large chamfer cutters 110 may optionally be employed, but oriented at a 10° cutter backrake. Further, the chamfer angle of cutters 110 in each of first region 226 and shoulder 236 may be other than 45°. For example, 70° chamfer angles may be employed with chamfer widths (looking vertically at the cutting face of the cutter) in the range of about 0.035 to 0.045 inch, cutters 110 being disposed at appropriate backrakes to achieve the desired chamfer rake angles in the respective regions.

A boundary region, rather than a sharp boundary, may exist between first and second regions 226 and 228. For example, rock zone 46 bridging the adjacent edges of rock zones 42 and 44 of formation 40, may comprise an area wherein demands on cutters and the strength of the formation are always in transition due to bit dynamics. Alternatively, the rock zone 46 may initiate the presence of a third region on the bit profile, wherein a third size of cutter chamfer is desirable. In any case, the annular area of profile 224 opposing zone 46 may be populated with cutters of both types (i.e., width and chamfer angle) and employing backrakes respectively employed in first region 226 and those of second region 228, or cutters with chamfer sizes, angles and cutter backrakes intermediate those of the cutters in first and second regions 226 and 228 may be employed.

Bit 200, equipped as described with a combination of small chamfer cutters 10 and large chamfer cutters 110, will drill with an ROP approaching that of conventional, non-directional bits equipped only with small chamfer cutters, but will maintain superior stability, and will drill far faster than a conventional directional drill bit equipped only with large chamfer cutters.

Figure 1:
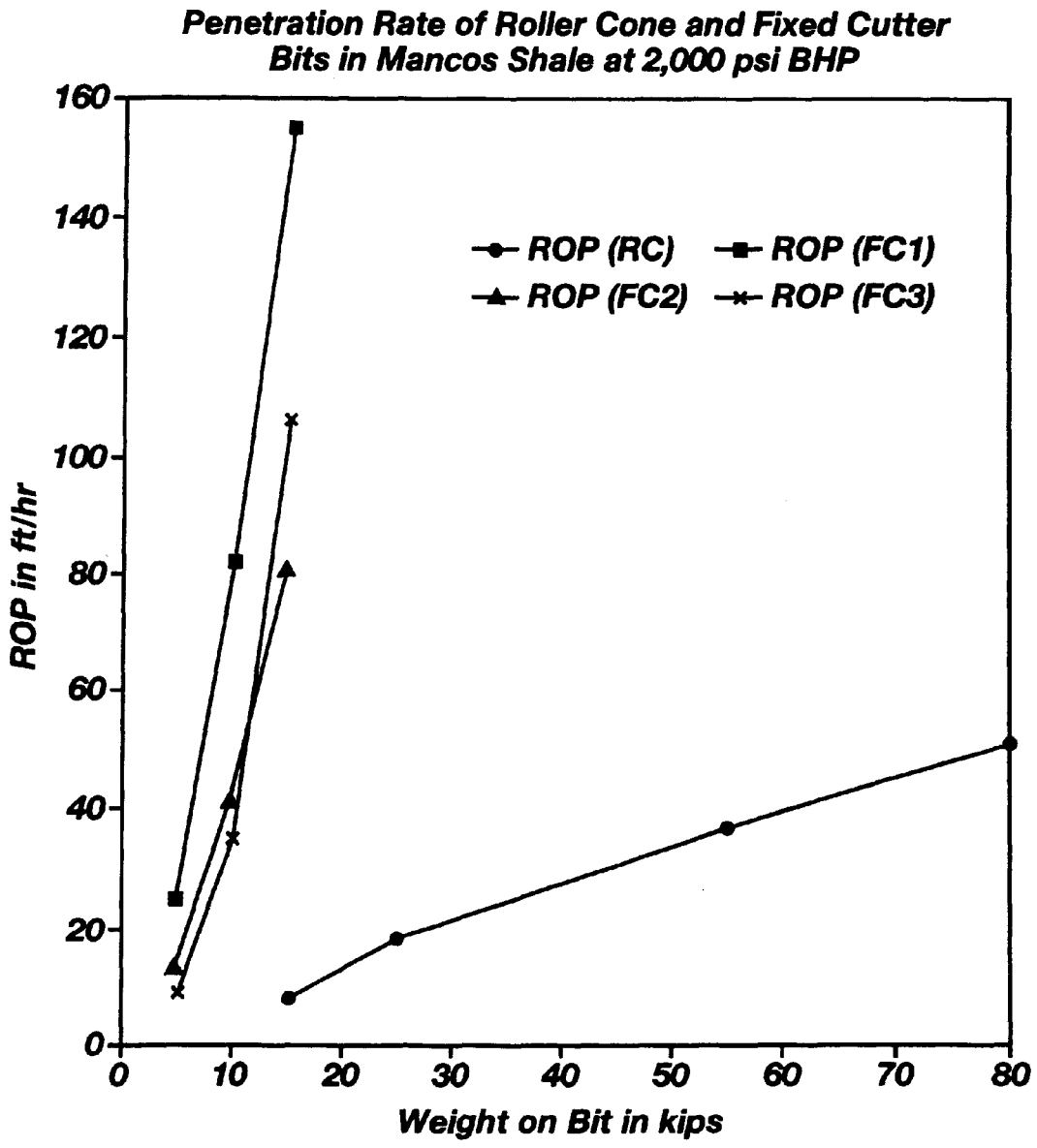
FIG. 1 comprises a graphical representation of ROP versus WOB characteristics of various rotary drill bits in drilling Mancos Shale at 2000 psi bottomhole pressure.
Figure 2:
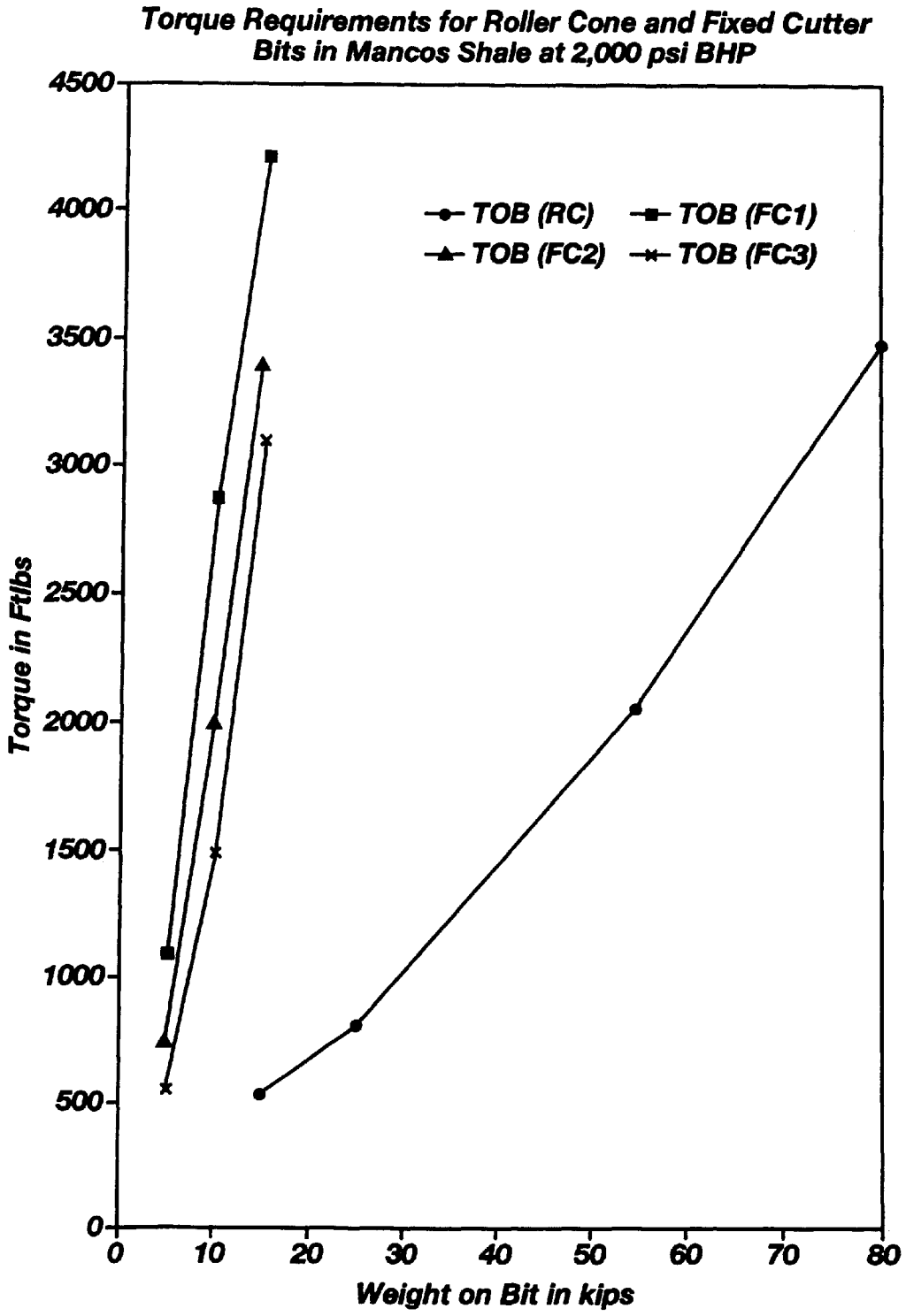
FIG. 2 comprises a graphical representation of TOB versus WOB characteristics of various rotary drill bits in drilling Mancos Shale at 2,000 psi bottomhole pressure.
Figure 11:
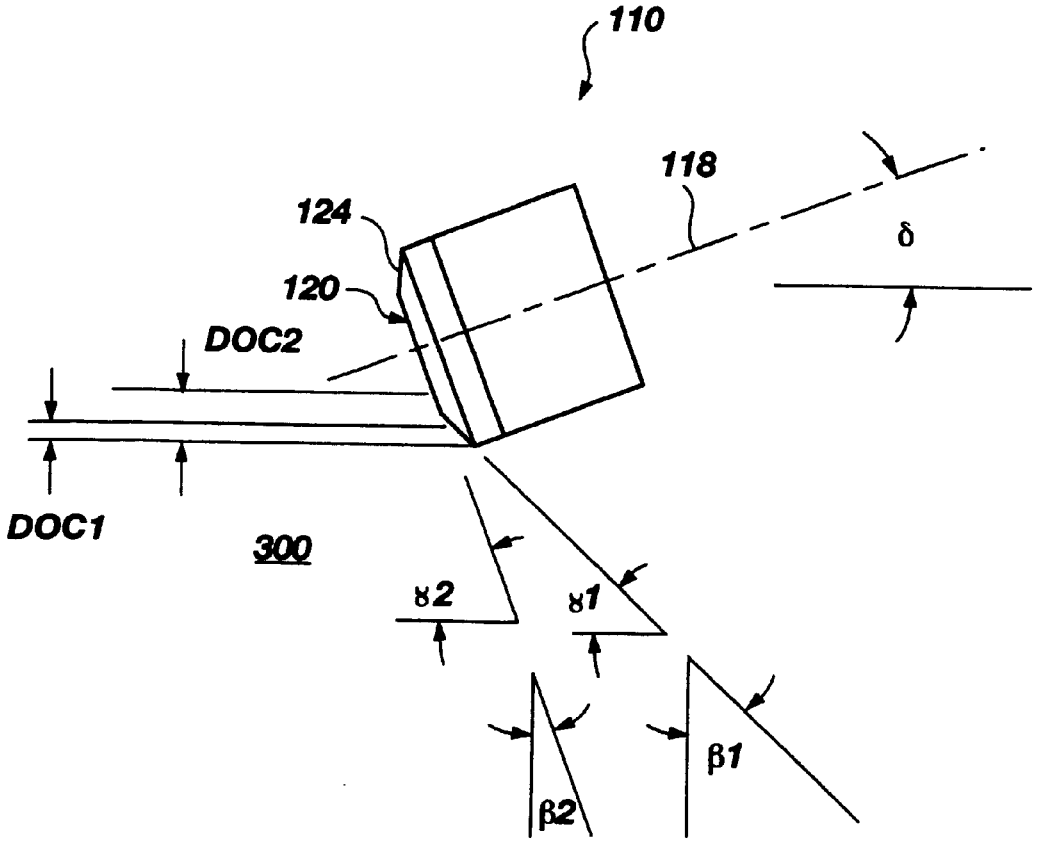
FIG. 11 comprises a side view of a PDC cutter as employed with the present invention, depicting the effects of chamfer backrake and cutter backrake.

It is believed that the benefits achieved by the present invention result from the aforementioned effects of selective variation of chamfer size, chamfer backrake angle and cutter backrake angle. For example and with specific reference to FIG. 11, the size (width) of the chamfer 124 of the large chamfer cutters 110 at the center of the bit can be selected to maintain non-aggressive characteristics in the bit up to a certain WOB or ROP, denoted in FIGS. 1 and 2 as the "break" in the curve slopes for bit FC3. For equal chamfer backrake angles β1, the larger the chamfer 124, the greater WOB must be applied before the bit enters the second, steeper-slope portions of the curves. Thus, for drilling non-linear borehole segments, wherein applied WOB is generally relatively low, it is believed that a non-aggressive character for the bit may be maintained by drilling to a first depth of cut (DOC1) associated with low WOB, wherein the cut is taken substantially within the chamfer 124 of the large chamfer cutters 110 disposed in the center region of the bit. In this instance, the effective backrake angle of the cutting face 120 of cutter 110 is the chamfer backrake β1, and the effective included angle γ1 between the cutting face 120 and the formation 300 is relatively small. For drilling linear borehole segments, WOB is increased so that the depth of cut (DOC2) extends above the chamfers 124 on the cutting faces 120 of the large chamfer cutters to provide a larger effective included angle γ2 (and smaller effective cutting face backrake angle β2) between the cutting face 120 and the formation 300, rendering the cutters 110 more aggressive and thus increasing ROP for a given WOB above the break point of the curve of FIG. 1. As shown in FIG. 2, this condition is also demonstrated by a perceptible increase in the slope of the TOB versus WOB curve above a certain WOB level. Of course, if a chamfer 124 is excessively large, excessive WOB may have to be applied to cause the bit to become more aggressive and increase ROP for linear drilling.

The chamfer backrake angle β1 of the large chamfer cutters 110 may be employed to control DOC for a given WOB below a threshold WOB wherein DOC exceeds the chamfer depth perpendicular to the formation. The smaller the included angle γ1 between the chamfer 124 and the formation 300 being cut, the more WOB is required to effect a given DOC. Further, the chamfer rake angle β1 predominantly determines the slopes of the ROP\WOB and TOB\WOB curves of FIGS. 1 and 2 at low WOB and below the breaks in the curves, since the cutters 110 apparently engage the formation to a DOC 1 residing substantially within the chamfer 124.

Further, selection of the backrake angles δ of the cutters 110 themselves (as opposed to the backrake angles β1 of the chamfers 124) may be employed to predominantly determine the slopes of the ROP\WOB and TOB\WOB curves at high WOB and above the breaks in the curves, since the cutters 110 will be engaged with the formation to a DOC2 such that portions of the cutting face centers of the cutters 110 (i.e., above the chamfers 124) will be engaged with the formation 300. Since the central areas of the cutting faces 120 of the cutters 110 are oriented substantially perpendicular to the longitudinal axes 118 of the cutters 110, cutter backrake δ will largely dominate effective cutting face backrake angles (now β2) with respect to the formation 300, regardless of the chamfer rake angles β1. As noted previously, cutter backrake angles δ may also be used to alter the chamfer rake angles β1 for purposes of determining bit performance during relatively low WOB drilling.

It should be appreciated that appropriate selection of chamfer size and chamfer backrake angle of the large chamfer cutters may be employed to optimize the performance of a drill bit with respect to the output characteristics of a downhole motor driving the bit during steerable or non-linear drilling of a borehole segment. Such optimization may be affected by choosing a chamfer size so that the bit remains non-aggressive under the maximum WOB to be applied during steerable or non-linear drilling of the formation or formations in question, and choosing a chamfer backrake angle so that the torque demands made by the bit within the applied WOB range during such steerable drilling do not exceed torque output available from the motor, thus avoiding stalling.

With regard to the placement of cutters exhibiting variously-sized chamfers on the exterior, and specifically the face of a bit, the chamfer widths employed on different regions of the bit face may be selected in proportion to cutter redundancy or density at such locations. For example, a center region of the bit, such as within a cone surrounding the bit centerline (see FIGS. 7 through 10 and above discussion), may have only a single cutter (allowing for some radial cutter overlap) at each of several locations extending radially outward from the centerline or longitudinal axis of the bit. In other words, there is only "single" cutter redundancy at such cutter locations. An outer region of the bit, portions of which may be characterized as comprising a nose, flank and shoulder, may, on the other hand, exhibit several cutters at substantially the same radial location. It may be desirable to provide three cutters at substantially a single radial location in the outer region, providing substantially triple cutter redundancy. In a transition region between the inner and outer regions, such as on the boundary between the cone and the nose, there may be an intermediate cutter redundancy, such as substantially double redundancy, or two cutters at substantially each radial location in that region.

Relating cutter redundancy to chamfer width for exemplary purposes in regard to the present invention, cutters at single redundancy locations may exhibit chamfer widths of between about 0.030 to 0.060 inch, while those at double redundancy locations may exhibit chamfer widths of between about 0.020 and 0.040 inch, and cutters at triple redundancy locations may exhibit chamfer widths of between about 0.010 and 0.020 inch.

Rake angles of cutters in relation to their positions on the bit face have previously been discussed with regard to FIGS. 7 through 10. However, it will be appreciated that differences in the chamfer angles from the exemplary 45° angles discussed above may necessitate differences in the relative cutter backrake angles employed in and within the different regions of the bit face in comparison to those of the example.

While the present invention has been described in light of the illustrated embodiment, those of ordinary skill in the art will understand and appreciate it is not so limited, and many additions, deletions and modifications may be affected to the invention as illustrated without departing from the scope of the invention as hereinafter claimed.

What is claimed is:

1. A rotary drag bit for drilling a subterranean formation, comprising:

a bit body comprising at least a first region and a second region over a face to be oriented toward the subterranean formation during drilling; and a plurality of cutters secured to the bit body in the first and second regions, the cutters of the plurality each comprising a cutting face having a preselected effective cutting face backrake angle, and being positioned substantially transverse to a direction of cutter movement during drilling and including a cutting edge located to engage the subterranean formation, wherein the respective cutting faces of a majority of cutters located in the first region exhibit substantially larger effective cutting face backrake angles than the effective cutting face backrake angles of the respective cutting faces of a majority of cutters located in the second region.

2. The rotary drag bit of claim 1, wherein the first region lies within a cone on the face of the bit body, and the second region extends at least over a nose and flank on the face of the bit body.

3. The rotary drag bit of claim 2, wherein the second region extends to a gage of the bit body.

4. The rotary drag bit of claim 1, wherein the cutting faces are formed on polycrystalline diamond compact tables.

5. The rotary drag bit of claim 4, wherein the polycrystalline diamond compact tables are supported by metallic substrates.

6. The rotary drag bit of claim 1, further including a boundary region on the bit body face lying between the first and second regions, and at least one cutter located in the boundary region having a preselected effective cutting face backrake angle intermediate the preselected effective cutting face backrake angles of the majority of first region cutters and the majority of second region cutters.

7. The rotary drag bit of claim 1, wherein the bit body further includes a plurality of generally radially oriented blades extending over the bit body face and to a gage, and wherein the first region cutters and the second region cutters are located on the generally radially oriented blades.

8. The rotary drag bit of claim 1, wherein the effective cutting face backrake angles of the cutters are determined at least in part by cutter backrake angles of the cutters.

9. The rotary drag bit of claim 8, wherein each of the cutters in the first region is oriented at a backrake angle greater than each of the backrake angles of the cutters in the second region.

10. The rotary drag bit of claim 1, wherein the first region lies within a cone on the face of the bit body, and the second region extends at least over a nose on the face of the bit body.

11. The rotary drag bit of claim 10, wherein at least one cutter proximate a gage portion of the bit body is backraked at an angle less than a cutter backrake angle of at least one cutter in the first region.

12. The rotary drag bit of claim 1, wherein the effective cutting face backrake angles of the plurality of cutters in the first and second regions are determined at least in part by cutter backrake angle and each of the cutters in the first region have effective cutter backrake angles greater than the effective backrake angles of each of the cutters in the second region; and wherein the cutters in the second region comprise cutters located relatively closer to the first region having greater cutter backrake angles than cutter backrake angles of other cutters in the second region but which are farther away from the first region.

13. A rotary drag bit for drilling a subterranean formation, comprising:

a bit body bearing a cutting structure thereon comprised of a plurality of superabrasive cutters, wherein at least some of the superabrasive cutters of the plurality are configured and oriented to provide different ROP versus WOB characteristics for the bit below and above about a threshold WOB.

14. A rotary drag bit for drilling a subterranean formation, comprising a bit body bearing a cutting structure thereon comprised of a plurality of superabrasive cutters, wherein at least some of the superabrasive cutters of the plurality are configured and oriented to provide different TOB versus WOB characteristics for the bit below and above about a threshold WOB.

* * * * *

UNITED STATES PATENT AND TRADEMARK OFFICE

CERTIFICATE OF CORRECTION

PATENT NO. : 6,443,249 B2
DATED : September 3, 2002
INVENTOR(S) : Christopher C. Beuershausen et al.

It is certified that error appears in the above-identified patent and that said Letters Patent is hereby corrected as shown below:

Column 1,
Line 61, change “recommence,” to -- recommenced, --

Column 2,
Line 53, insert a period after “itself”

Column 4,
Line 12, change the comma after “employed” to a semicolon

Column 6,
Line 25, change “performed” to -- preformed --

Column 7,
Line 38, change “DOC 1” to -- DOC1 --

Signed and Sealed this

Seventh Day of September, 2004

JON W. DUDAS
*Director of the United States Patent and Trademark Office*